US008727461B2

(12) United States Patent
Holzapfel et al.

(10) Patent No.: US 8,727,461 B2
(45) Date of Patent: May 20, 2014

(54) FURNITURE FITTING FOR FASTENING A FRONT PANEL

(71) Applicant: Julius Blum GmbH, Hochst (AT)

(72) Inventors: Andreas Holzapfel, Bregenz (AT); Benjamin Hoffmann, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/899,961

(22) Filed: May 22, 2013

(65) Prior Publication Data

US 2013/0257252 A1 Oct. 3, 2013

Related U.S. Application Data

(63) Continuation of application No. PCT/AT2011/000443, filed on Nov. 2, 2011.

(30) Foreign Application Priority Data

Nov. 23, 2010 (AT) ..... A 1939/2010

(51) Int. Cl.
*A47B 96/00* (2006.01)

(52) U.S. Cl.
USPC ..... 312/348.4; 312/265.5

(58) Field of Classification Search
USPC ..... 312/348.4, 348.1, 348.2, 265.5, 265.6, 312/330.1, 263; 403/231, 321, 322.1, 403/322.4, 381, 382, 409.1, 325, 327, 230, 403/319, 320, 329, DIG. 10, DIG. 12, 403/DIG. 13

See application file for complete search history.

(56) References Cited

U.S. PATENT DOCUMENTS

| | | | | |
|---|---|---|---|---|
| 4,832,420 | A | 5/1989 | Röck et al. | |
| 4,846,538 | A * | 7/1989 | Rock et al. | 312/263 |
| 5,281,022 | A | 1/1994 | Röck | |
| 5,540,515 | A | 7/1996 | Röck et al. | |
| 5,860,718 | A * | 1/1999 | Brustle | 312/348.2 |

(Continued)

FOREIGN PATENT DOCUMENTS

| | | |
|---|---|---|
| AT | 509 411 | 8/2011 |
| DE | 38 01 103 | 8/1988 |

(Continued)

OTHER PUBLICATIONS

International Search Report issued Feb. 14, 2012 in corresponding International (PCT) Application No. PCT/AT2011/000443.

Austrian Search Report issued Jul. 5, 2011 in Austrian Patent Application No. A 1939/2010 with English Translation.

*Primary Examiner* — Janet M Wilkens

(74) *Attorney, Agent, or Firm* — Wenderoth, Lind & Ponack, L.L.P.

(57) ABSTRACT

A furniture fitting for fastening a front panel to a drawer frame includes a connecting element associated with the front panel and which can be pre-mounted on the front panel, and a fastening device associated with the drawer frame and which can be connected to the frame and which has a frame plate. An adjusting plate and adjusting elements are arranged, in particular rotatably, on the adjusting plate and act on the adjusting plate, by which adjusting elements the adjusting plate can be adjusted relative to the frame plate in the height direction (HR) and in the lateral direction (SR). The connecting element can be hooked onto the adjusting plate and, while hooked in, follows the adjustment motions of the adjusting plate relative to the frame plate.

12 Claims, 14 Drawing Sheets

(56) References Cited

U.S. PATENT DOCUMENTS

| | | | | |
|---|---|---|---|---|
| 6,981,752 | B2 | 1/2006 | Harn et al. | |
| 2004/0100852 | A1* | 5/2004 | Scheuerlein et al. | 365/230.06 |
| 2007/0228906 | A1* | 10/2007 | Netzer | 312/348.4 |
| 2010/0102692 | A1 | 4/2010 | Hämmerle | |
| 2012/0286116 | A1 | 11/2012 | Gasser | |
| 2013/0249370 | A1* | 9/2013 | Kueng | 312/348.4 |

FOREIGN PATENT DOCUMENTS

| | | |
|---|---|---|
| DE | 195 10 119 | 9/1996 |
| EP | 0 636 327 | 2/1995 |
| EP | 1 364 597 | 11/2003 |
| EP | 1 516 561 | 3/2005 |
| WO | 2007/137311 | 12/2007 |
| WO | 2009/006651 | 1/2009 |

* cited by examiner

FURNITURE FITTING FOR FASTENING A FRONT PANEL

BACKGROUND OF THE INVENTION

The invention concerns a furniture fitting for fastening a front panel to a drawer frame member. The fitting includes a connecting element which is associated with the front panel and which can be pre-mounted to the front panel, and a fastening device which is associated with the drawer frame member and which can be connected to the frame member and which has a frame plate. An adjusting plate and adjusting elements are arranged on the frame plate, in particular rotatably, and act on the adjusting plate so that the adjusting plate is displaceable relative to the frame plate in the height direction and in the lateral direction. The invention also concerns a drawer having such a furniture fitting and an article of furniture having a corresponding drawer.

The most widely varying possible ways of mounting a front panel to a drawer container, in particular to the drawer frame, are known in the state of the art. In that respect, on the one hand it is important for the front panel to be relatively easily mounted to the frame member and quickly releasable from the drawer frame member. On the other hand, it is also important for adjustment options to be provided in order to be able to adjust the front panel with respect to the drawer frame member at least in the height and the lateral directions.

An example of such a drawer frame member with a corresponding furniture fitting can be found in WO 2009/006651, in which provided in the region of the drawer frame member are a base plate and a mounting plate and a corresponding height adjusting device as well as a holding plate and an inclination adjusting device. In contrast, a lateral adjusting device is arranged at the connecting element which can be mounted to the front panel. A disadvantage with this structure is the relatively large amount of space required for the overall drawer frame. That means that the drawer frame member is relatively wide (over 2 cm) in particular in the lower region and thus reduces the volume available in the drawer (high space requirement). In addition, the locking mechanism and also the individual adjusting mechanisms are highly complex and involve relatively many parts and are thus complicated.

In a similar fashion, and involving the same disadvantages, EP 0 636 327 A1 discloses a device for fastening a front panel of a drawer to drawer frame members. In that case, an eccentric serves for heightwise adjustment of a receiving plate with respect to a base plate. A holding portion which can be fitted to the front panel by way of dowels is hung in hooking engagement on the receiving plate. That hooked holding portion can be laterally adjusted by way of a head of an adjusting screw. Thus, the eccentric for heightwise adjustment engages on another part than the head of the adjusting screw for lateral adjustment.

In addition, application AT 509 411, which is not a prior publication but which is of earlier priority, discloses a drawer frame member forming the classifying portion of the claim according to the invention. That specification already discloses a relatively narrow (less than 1 cm thick) drawer frame member to which a front panel can be releasably arrested. Adjusting elements for lateral and height adjustment of an adjusting plate are provided in that frame member, in the fastening device for the front panel. That adjusting panel at the same time forms the connecting element which can be pre-mounted to the front panel. Upon removal of the front panel from the rest of the drawer container, the adjusting panel is also released from the fastening device and thus from the individual adjusting elements.

SUMMARY OF THE INVENTION

The object of the present invention is that of providing a furniture fitting which is improved over the state of the art. In particular, the invention seeks to provide that the space required for the furniture fitting is reduced, while at the same time the invention aims to provide that the functionality for lateral adjustment, height adjustment, and for locking purposes are integrated in that furniture fitting in as compact a structure as possible.

For a furniture fitting having the features of the classifying portion of the present invention, that object is attained in that the connecting element can be hung on the adjusting plate and in the hung condition also performs the displacement movements of the adjusting plate relative to the frame plate. In contrast to the third-mentioned Austrian specification of earlier priority, in that way the front panel with connecting element can be released from the fastening device, in which case the adjusting plate which is suitably adjusted by the adjusting elements remains in the fastening device and it is thus ensured, when the front panel is re-fitted, that the previously set position of the front panel is unchanged upon re-fitting thereof. By virtue of that arrangement, the drawer wall (thickness of the frame member) can also be reduced to below 15 mm, preferably to below 11 mm or even to only a maximum of 8 mm. In addition, the two adjusting elements for lateral and height adjustment are associated with the fastening device so that the front panel together with the connecting element can be of a very simple configuration. The expression 'associated with the front panel' means that the corresponding parts, in the case of a front panel in the unhooked condition, are arranged on the front panel. In contrast thereto, the expression 'associated with the drawer frame member' means that the corresponding parts, when the front panel is removed, remain on the drawer frame member or the fastening device thereof.

In a preferred embodiment of the present invention, the adjusting plate can have at least one hang-in groove into which the connecting element can be hung by way of a preferably pin-shaped latching element. In that arrangement, that hang-in groove has preferably vertically upwardly facing side boundaries so that when the front panel is fitted in position, the latching elements remain in the hang-in groove due to the force of gravity.

Particularly in the case of high front panels (over 25 cm), the adjusting plate can have two hang-in grooves into which the connecting element can be hung by way of a respective, preferably pin-shaped latching element. In that case, the individual latching elements are arranged in vertically superposed relationship. It will be appreciated that the possibility of three or more latching elements also being arranged in mutually superposed relationship on a one-piece or multipiece connecting element should not be ruled out. It should also be pointed out that identical connecting elements are arranged on both side regions of a front panel, which connecting elements appropriately correspond with the two drawer side walls formed by the frame members. The frame members preferably have fastening devices which are of mirror-image configuration relative to each other.

Preferably the connecting element can be adapted so that it has two substantially mutually parallel side plates, and arranged between the side plates is a pin which connects the side plates and which forms the latching element and by which the connecting element can be hung on the adjusting plate of the fastening device. The connecting element is thus preferably in the form of a slider which can be pushed on.

To provide that the connecting element is mounted to the fastening device (more specifically to the groove of the adjusting plate) with as accurate a fit as possible, the spacing between the substantially mutually parallel side plates, at least in the region of the pin forming the latching element, is at a maximum 40% greater than the thickness of the adjusting plate. By virtue of that somewhat greater spacing between the two side plates relative to the thickness of the adjusting plate, the connecting element can be relatively unimpededly hung on the adjusting plate but nonetheless this avoids an excessively large play in respect of the connecting element relative to the adjusting plate in the lateral direction. Lateral adjustment is also facilitated by the lateral play.

Alternatively, however, the spacing between the two side plates can also be very much larger. In that case, the rivet-form pin can have a suitable recess or notch which is adapted to the thickness of the adjusting plate in the region of the groove so that, in the mounted position, in the front panel, there is scarcely any play between the latching element and the adjusting plate.

To achieve a particularly stable structure for the connecting element, the connecting element can have a U-shaped cross-section, wherein the two substantially mutually parallel side plates are connected together by a transverse limb remote from the pin.

For easily fitting and securely holding the front panel to the frame member, the fastening device can have a locking device by which the connecting element hung on the adjusting plate can be releasably arrested to the fixing device. Preferably, the front panel can be fitted to the drawer frame member without a tool, whereas a tool (screwdriver or the like) should be used when releasing the locking device.

The adjusting plate can also be pivotable in the lateral direction with respect to the frame plate by a first adjusting element in the form of a lateral adjusting device, and can be displaceable in the height direction with respect to the frame plate by a second adjusting element in the form of a height adjusting device. In that case, the lateral adjusting device is preferably in the form of a thread, wherein the adjusting plate acts in the region of the thread flights and can be laterally pivoted by rotation. The height adjusting device is preferably in the form of an eccentric which acts on the adjusting plate and which moves the adjusting plate to different heights depending on the respective position. Preferably, the axis of rotation of the two adjusting elements is fixed in position relative to the frame plate of the fastening device. In principle, however, the possibility should not be excluded that the adjusting elements can be actuated not rotatably but for example slidably. In order to permit adjustment at all, there is sufficient play between the first adjusting element and the adjusting plate in the height direction, to allow displacement of the second adjusting element in the height direction. In a corresponding fashion, there is also sufficient play between the second adjusting element and the adjusting plate in the lateral direction to allow displacement of the first adjusting element in the lateral direction.

The possibility should not be ruled out that the adjusting plate has a multi-part configuration so that the adjusting elements as well as a provided locking element act on different portions of the adjusting plate. Preferably, however, the adjusting plate is in one piece and both adjusting elements act on the one-piece adjusting plate.

To be able to move the adjusting plate within predetermined limits with respect to the frame plate of the fastening device, the adjusting plate is preferably connected non-releasably and movably to the frame plate by mounting elements. Preferably, the frame plate has two substantially mutually parallel and mutually fixed plate portions, and the adjusting plate is arranged between the two plate portions. The two plate portions and the adjusting plate are connected together by way of the mounting elements. In that case, mounting elements connect only the two plate portions of the frame plate together. In that case, two mounting elements should also be provided at the region of the frame plate, that is remote from the front panel, wherein the adjusting plate is held to the mounting elements displaceably in the height direction by way of slots in the adjusting plate and in the assembled condition is held non-releasably between the plate portions of the frame plate.

The invention also relates to a drawer having the features described above, and to an article of furniture having the features of claim 12.

BRIEF DESCRIPTION OF THE DRAWINGS

Further details and features of the present invention will be described more fully hereinafter by means of the specific description with reference to the embodiments by way of example illustrated in the drawings, in which.

DETAILED DESCRIPTION OF THE INVENTION

Figure 1:
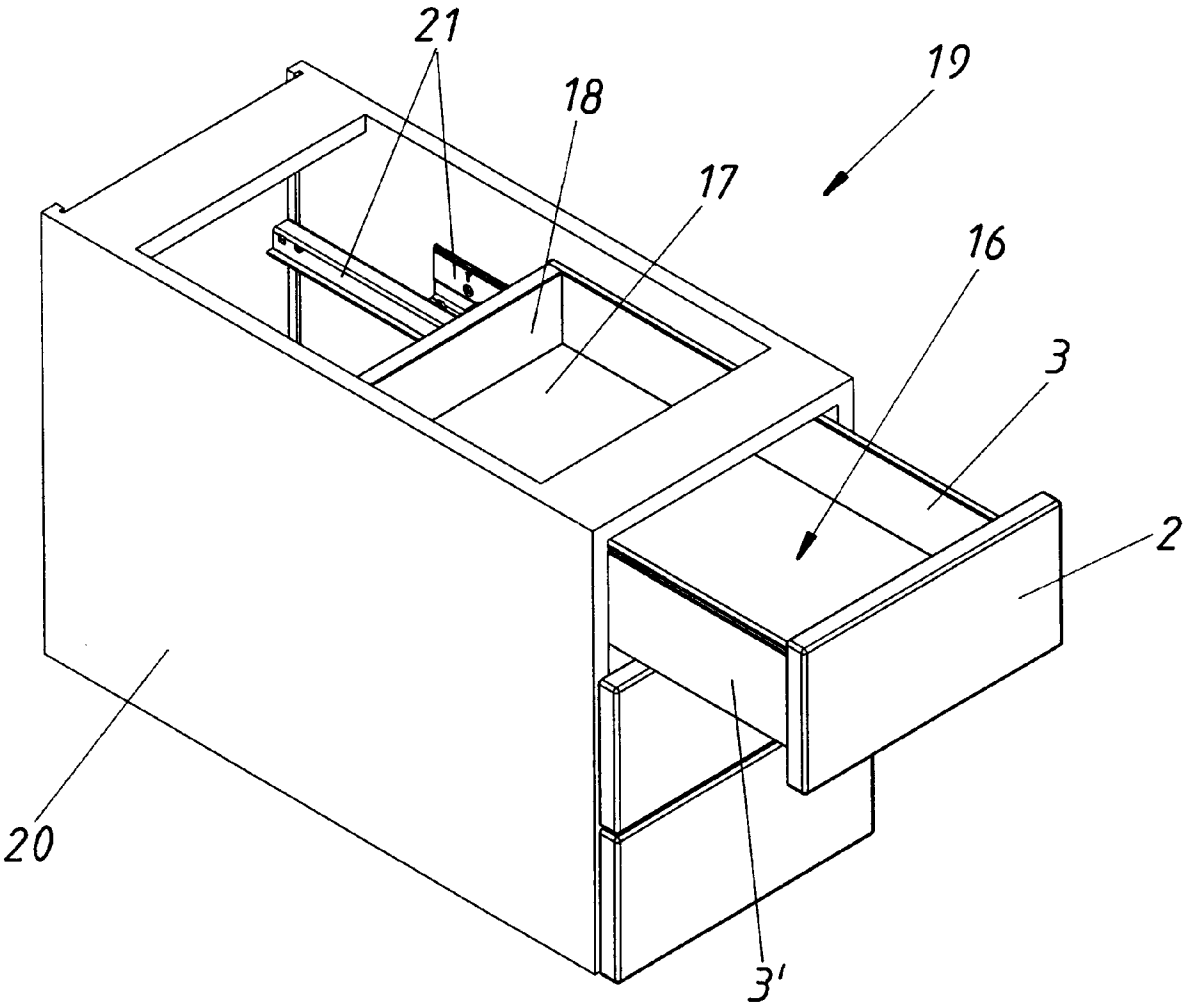
FIG. 1 shows a view of an article of furniture.

FIG. 1 shows a perspective view of the article of furniture 19 comprising a furniture carcass 20 and a drawer 16 movable relative to the furniture carcass 20 by an extension guide 21. In this case, the drawer 16 has a drawer bottom 17, a drawer rear wall 18, two drawer frame members 3 and 3' forming the drawer side walls, and a front panel 2 which can be connected to the drawer frame members 3 and 3'.

Figure 2:
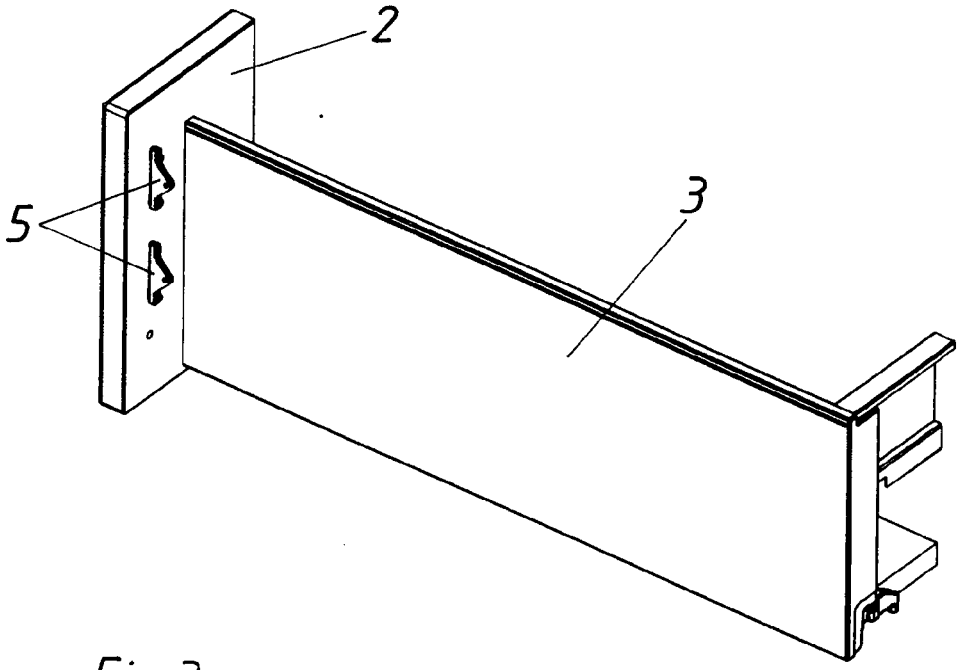
FIG. 2 shows a view of a frame member and a front panel prior to fastening.
Figure 3:
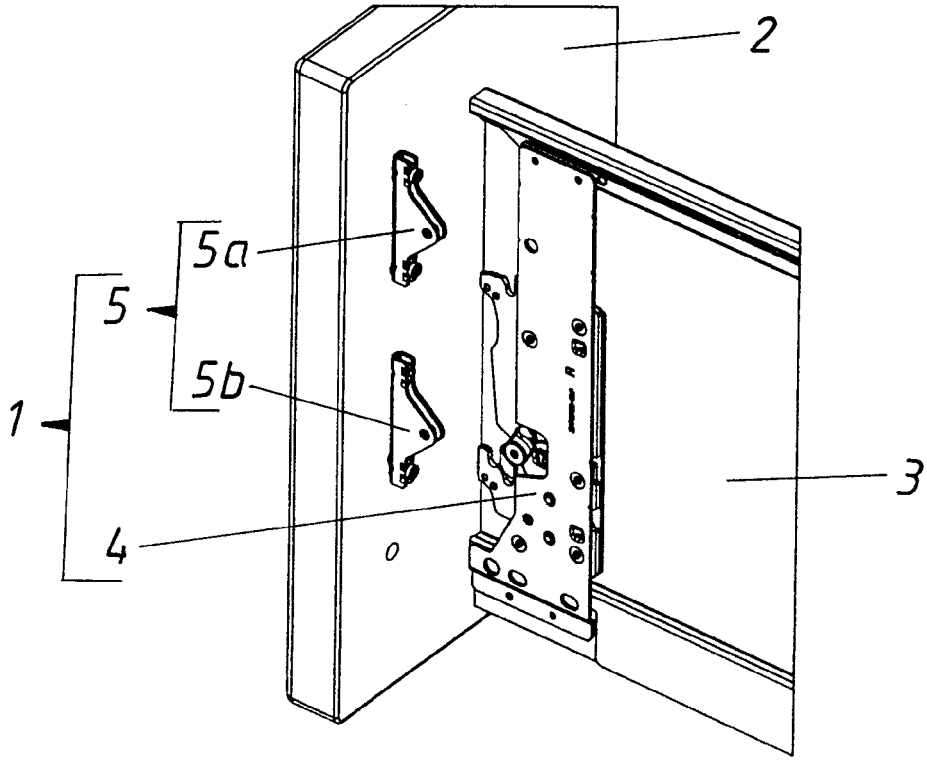
FIG. 3 shows a view of the portions of the furniture fitting, that have not yet been connected together.

FIG. 2 shows a two-part connecting element pre-mounted to the front panel 2, prior to mounting to the drawer frame member 3. FIG. 3 shows the fastening device 4 which is provided in the drawer frame member and which forms the furniture fitting 1, with the first portion 5*a* and the second portion 5*b* of the connecting element 5. In this case those two portions 5*a* and 5*b*, in the mounted condition on the front panel 7*a*, are in a fixed, non-displaceable positional relationship with each other and are arranged in mutually aligned relationship on the front panel 2. Preferably, those two portions 5*a* and 5*b* are of a substantially mutually identical configuration.

Figure 4:
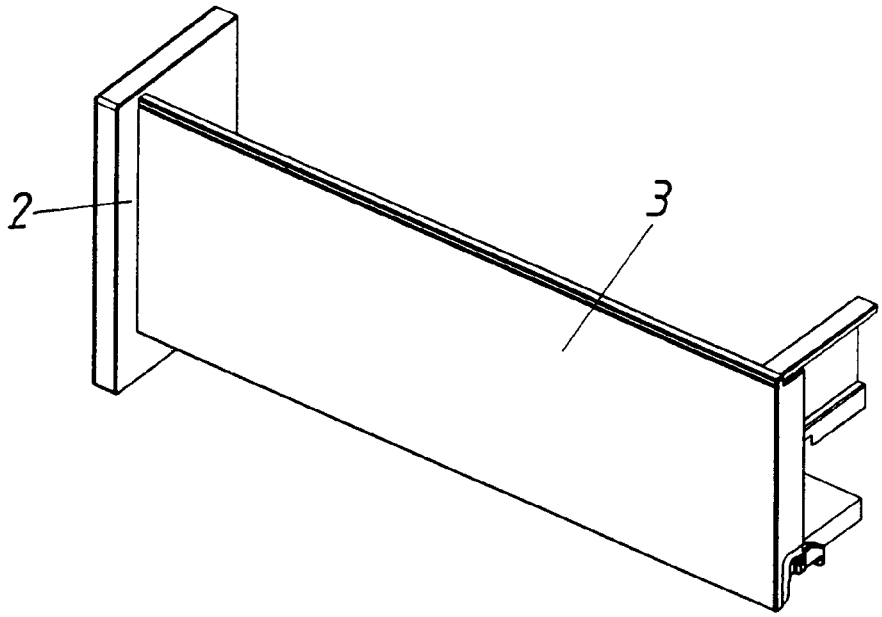
FIG. 4 shows the front panel mounted to the frame member.
Figure 5:
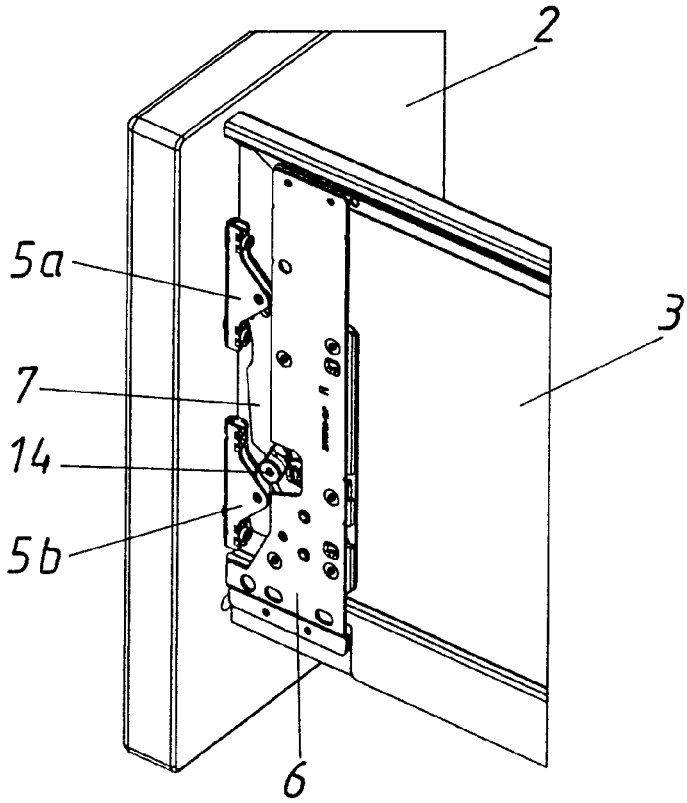
FIG. 5 shows the interconnected portions of the furniture fitting.

FIG. 4 shows the drawer frame member 3 in the position of being mounted to the front panel 2. Matching that, FIG. 5 shows the furniture fitting 1 with connecting elements 5*a* and 5*b* connected to the fastening device 4 and releasably arrested by the locking device 14.

Figure 6:
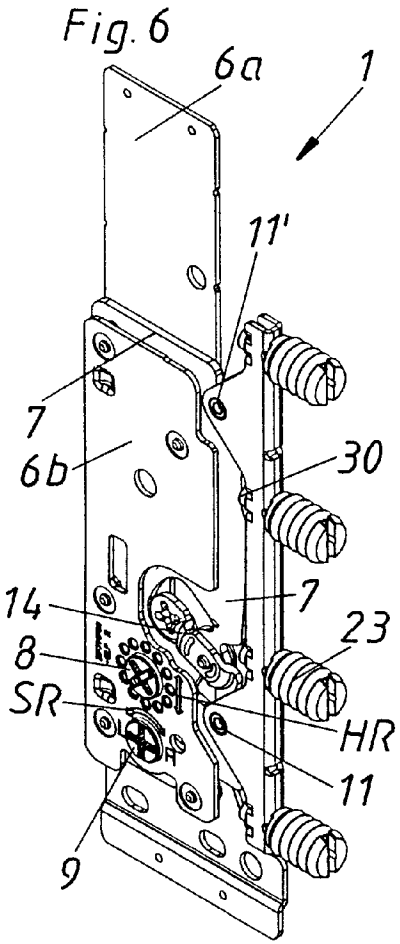
FIG. 6 shows a perspective view of the interconnected portions of a furniture fitting.

FIG. 6 shows a furniture fitting 1 in which the connecting element 5 is mounted to the fastening device 4. In this case, the fastening device 4 substantially comprises the two plate portions 6*a* and 6*b* of the frame plate 6, the adjusting plate 7, the two adjusting elements 8 and 9, and the locking device 14. As essential components, the connecting element 5 has the base element of a U-shaped cross-section as well as the latching elements 11 and 11' and the mounting elements 23. Those mounting elements 23 are preferably in the form of dowels and serve for fitting the connecting element 5 to the front panel 2, wherein the dowels are fixed by way of spreader portions 30 in pre-bores suitably provided in the front panel.

Figure 7:
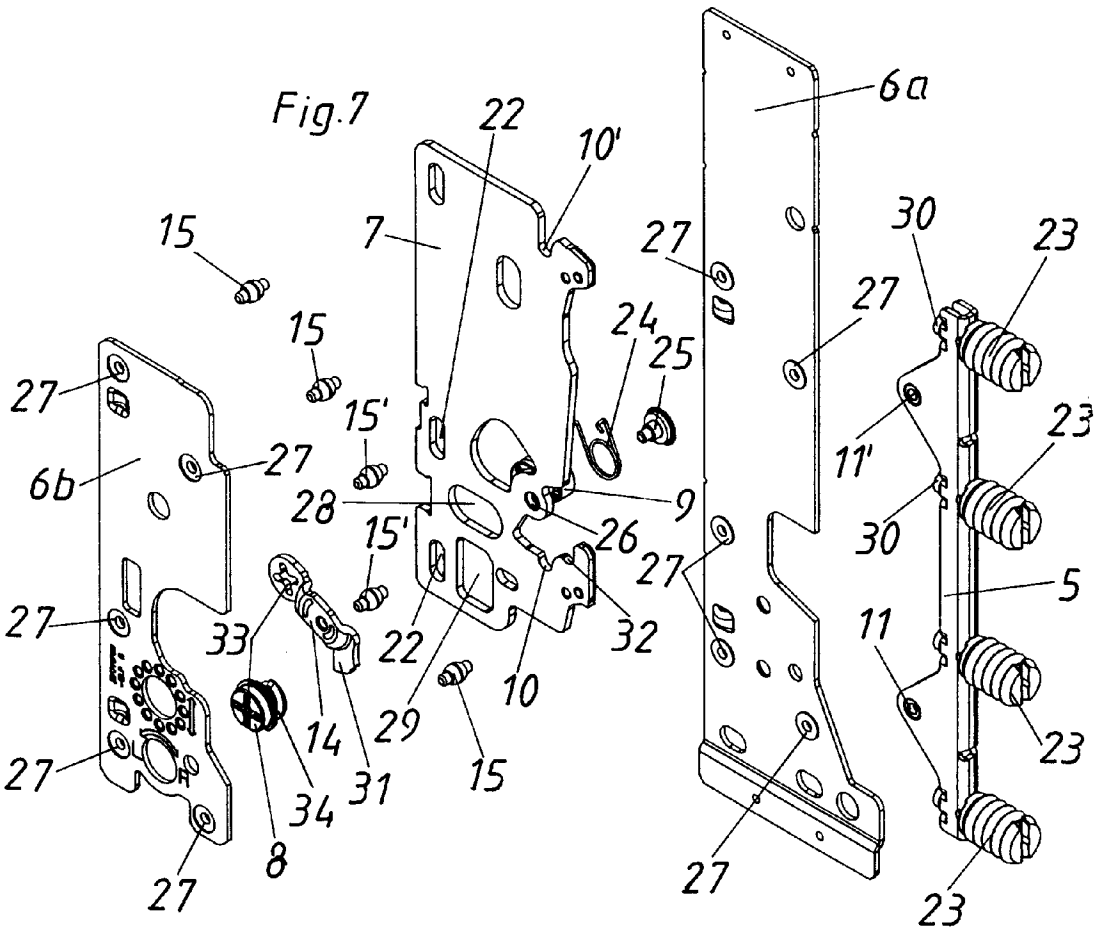
FIG. 7 shows an exploded view of FIG. 6.
Figure 12:
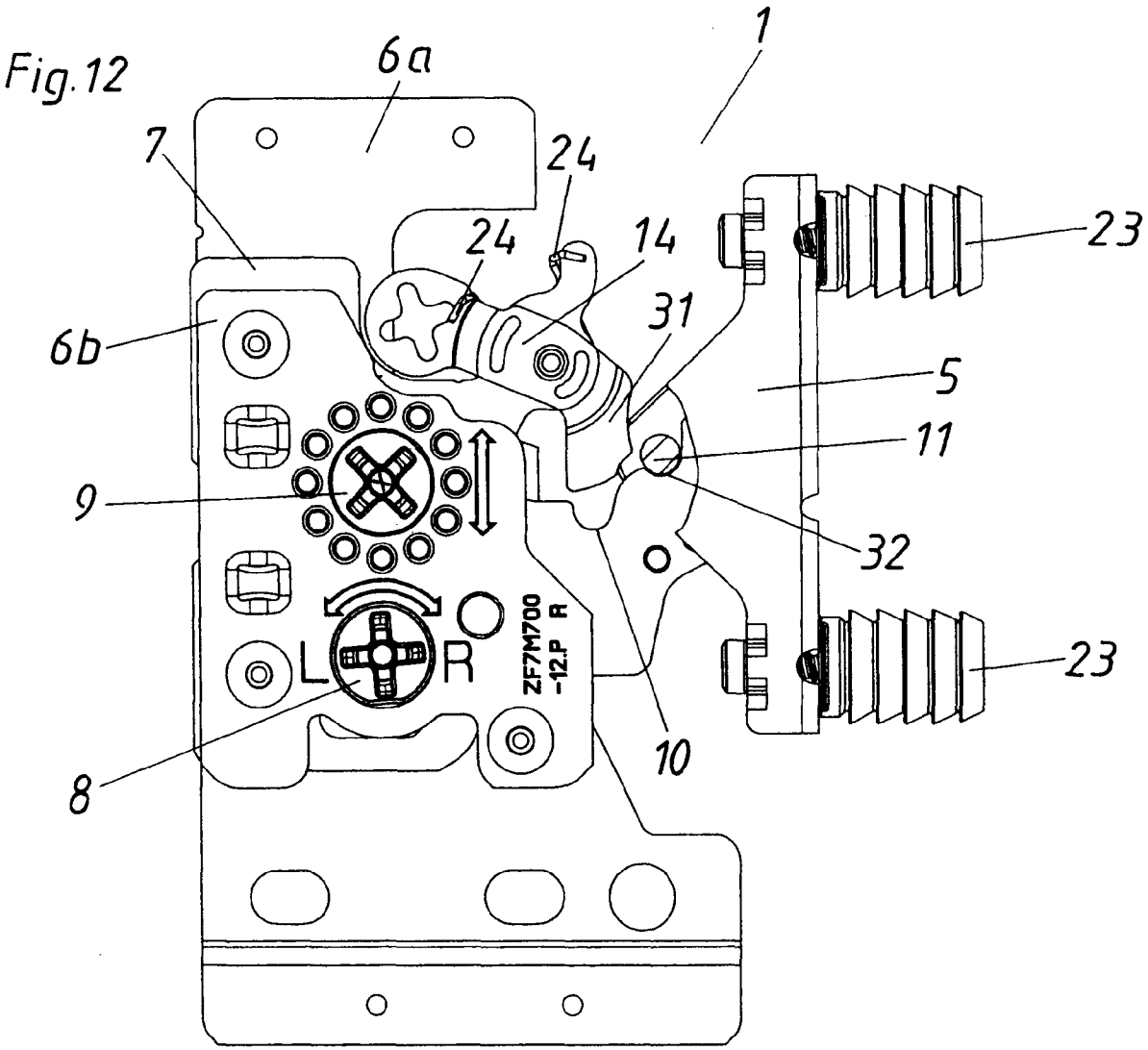
FIG. 12 shows a side view with the connecting element in the pre-hangingly engaged condition.

The exploded view in FIG. 7 shows the five mounting locations 27 on the plate portion 6*b*. The appropriately corresponding mounting locations on the plate portion 6*a* are also denoted by reference number 27. The two plate portions 6*a* and 6*b* of the frame plate 6 can be connected in mutually fixed relationship by the mounting elements 15 and 15', and in the connected condition the mounting elements 15' bear in as play-free relationship as possible against the slots 22 in the adjusting plate 7 so that the adjusting plate 7 is non-detachable but is nonetheless displaceable relative to the frame plate 6 in the height direction HR. In this case, those mounting elements 15' may have a central region which is partly in the shape of a portion of a sphere. The adjusting element 8 for displacement in the lateral direction SR is mounted rotatably in the plate portion 6*b* and by way of the thread 34 engages an edge of the receiving opening 29 in the adjusting plate 7. By actuation (rotation) of the adjusting element 8 by a tool engaging the cross slot 33, the adjusting plate 7 is pivoted with respect to the plate portions 6*a* and 6*b* as the adjusting plate 7 is held centrally between the plate portions 6*a* and 6*b* by the mounting elements 15' which are remote from the front panel. In that respect, the mounting elements 15' so-to-speak form the pivot axis for the adjusting plate 7. In addition, the adjusting element 9 is shown for positional adjustment of the adjusting plate 7 in the height direction HR relative to the plate portions 6*a* and 6*b*. The adjusting element 9 is mounted rotatably in the plate portion 6*b* and has an eccentric bulge portion 35 (see in particular FIG. 8), wherein that bulge portion bears against the edges of the receiving opening 28 in the adjusting plate 7 and height adjustment of the adjusting plate 7 is achieved by rotating that adjusting element 9 (for a detailed representation of this attention is directed for example to FIGS. 12 and 13 of AT 509 411). Associated with the adjusting plate 7 is a locking element 14 which is mounted rotatably by a rotational axis portion 25 on the rotational axis receiving member 26 of the adjusting plate 7, and that locking element 14 is acted upon by the force of a locking spring 24. FIG. 7 also shows the hang-in grooves 10 and 10' at which the connecting element 5 can be hung in hooking engagement by the latching elements 11 and 11'.

Figure 9:
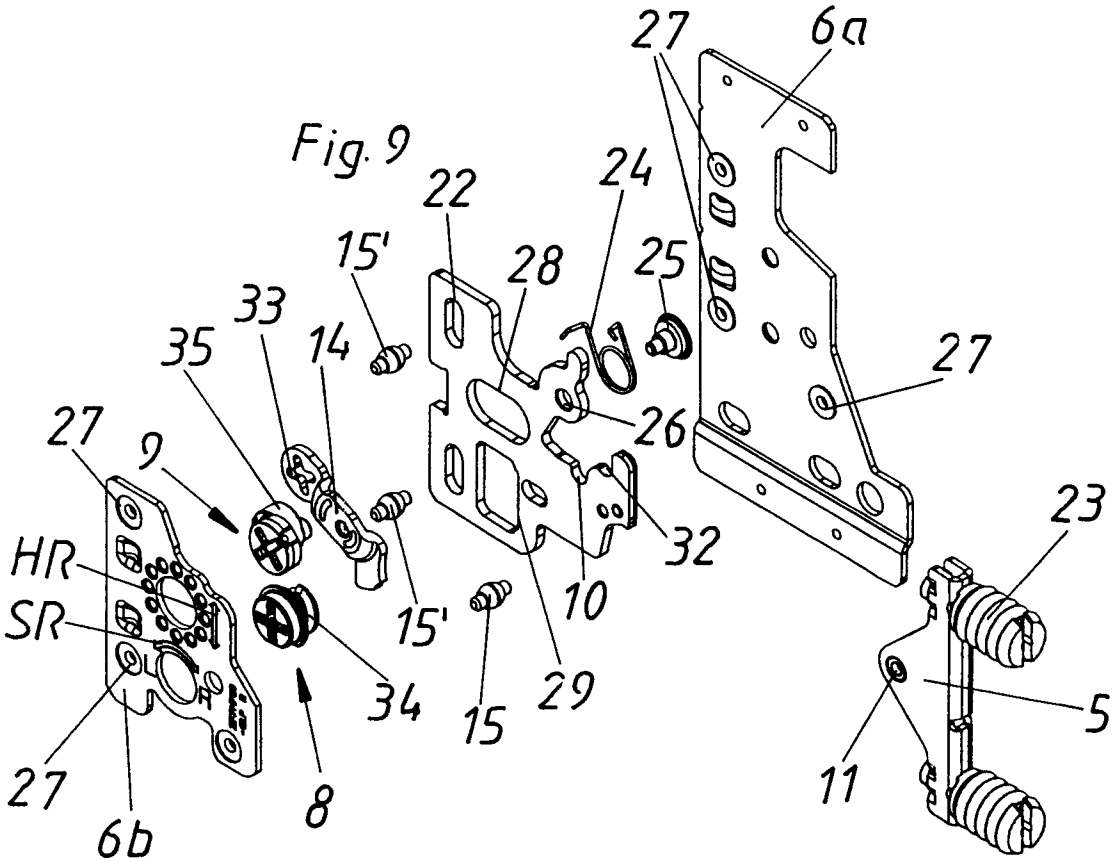
FIG. 9 shows an exploded view of FIG. 8.
Figure 8:
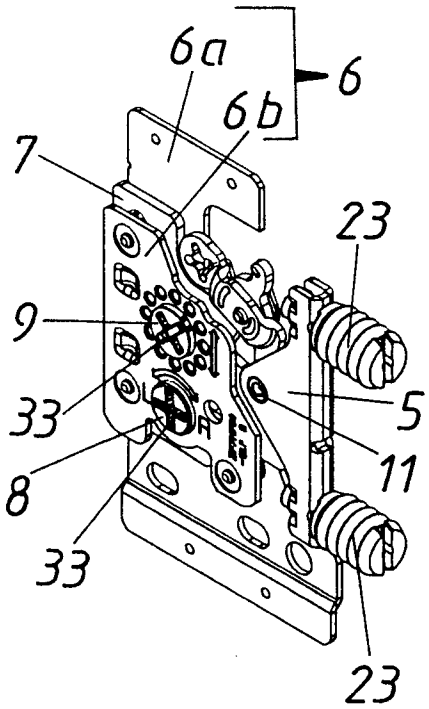
FIG. 8 shows a perspective view of a furniture fitting with a connecting element for a low front panel.

FIGS. 8 and 9 show a furniture fitting 1 for a low front panel 2, in which the connecting element 5 has only one latching element 11. Accordingly, only one hang-in groove 10 is also provided in the region of the fastening device 4. In principle, the possibility should not be ruled out that the connecting element 5 has more than the two illustrated mounting elements 23. However, as a preferred implementation, each latching element 11 can have two mounting elements 23 arranged at an equal spacing relative to the latching element 11.

Figure 11:
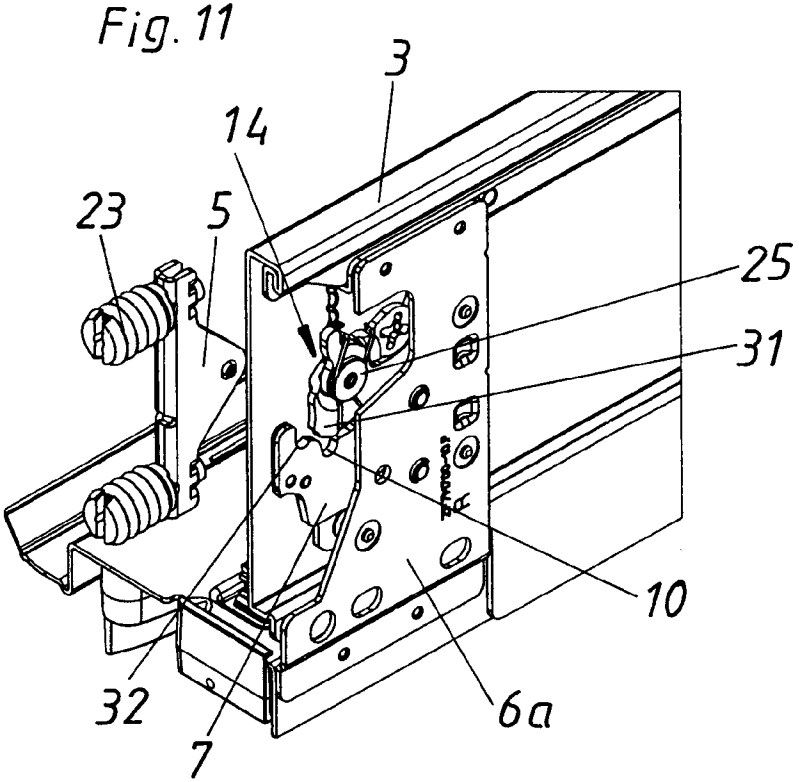
FIG. 11 shows a perspective view of FIG. 10.
Figure 10:
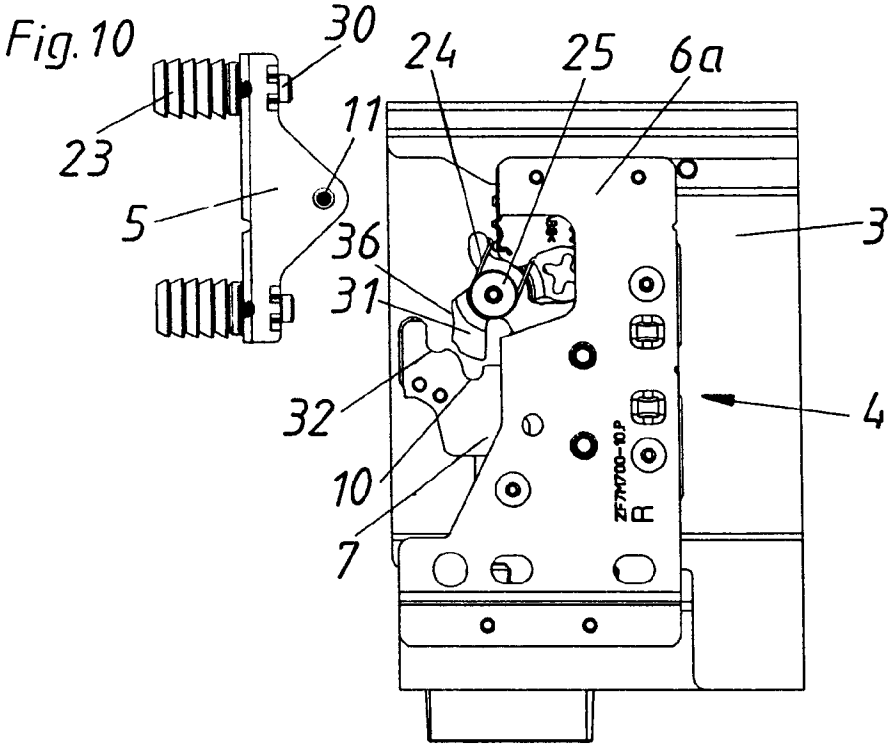
FIG. 10 shows a fastening device prior to connection to the connecting element.

FIGS. 10 and 11 show the position of the locking element 14 prior to mounting of the connecting element 5, with the locking spring 24 being in the (at least relatively) relieved condition. The slightly recessed region 36 of the locking element 14, together with the groove-shaped recess 32 in the adjusting plate 7, forms a guide for initial hanging engagement of the connecting element 5 and its latching element 11. A corresponding 'pre-hanging engagement position' is shown in relation thereto in FIG. 12. In particular, the groove-shaped recess 32 serves to provide that, upon unlocking of the connecting element 5 or the front panel 2, the panel 2 is prevented from dropping down and unlocking is assisted. It will also be clearly apparent from FIG. 12 that the locking spring 24 bears, on the one hand, against the locking element 14 and on the other hand against the adjusting plate 7.

Figure 13:
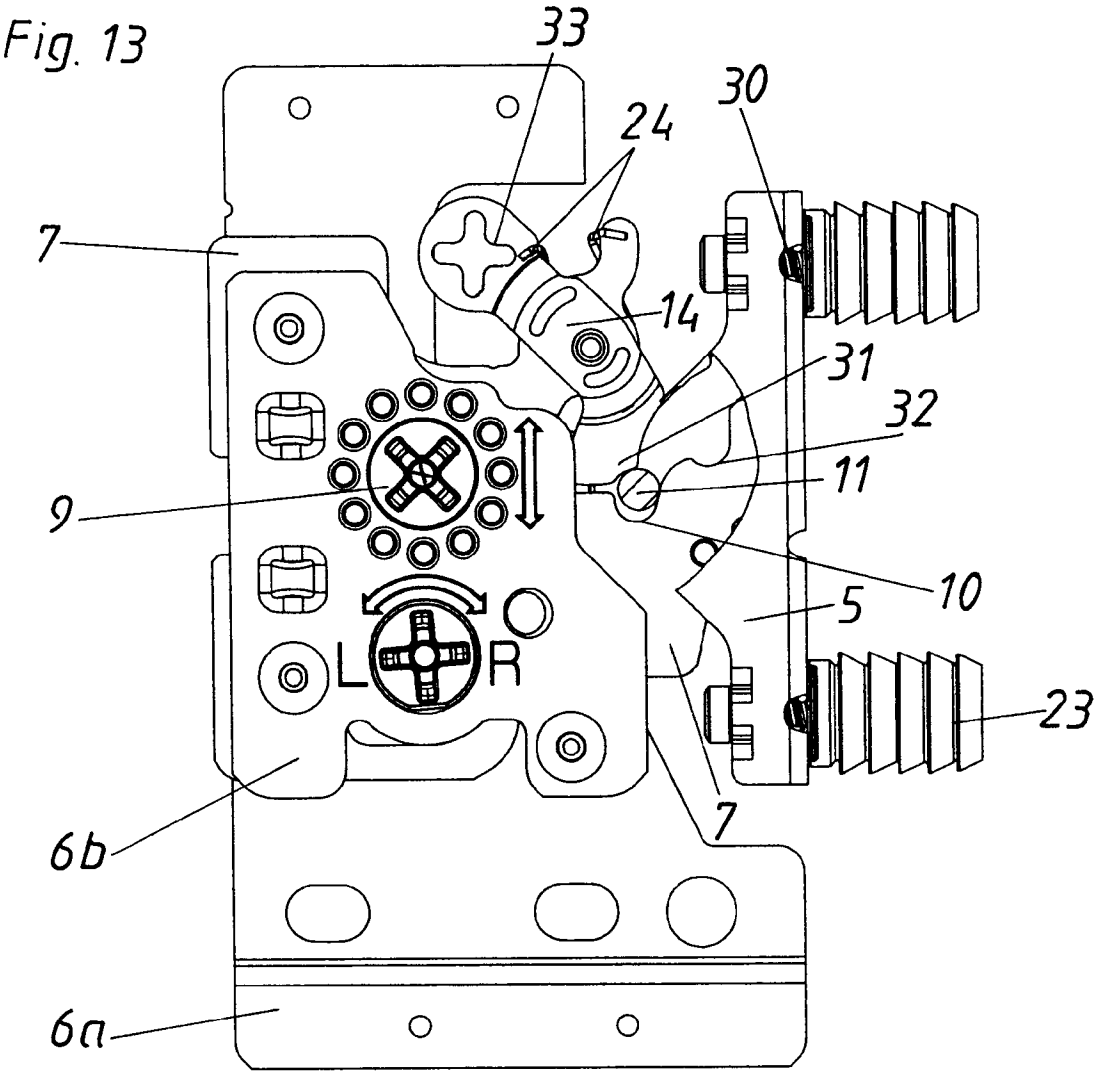
FIG. 13 shows a side view when involving snapping engagement of the latching element into the hang-in groove.

FIG. 13 shows the connecting element 5 and its latching element upon connection or snapping engagement on the fastening device 4. The locking device 14 is rotated in the clockwise direction about the axis of the rotary axis portion 25 by movement of the locking nose 31 towards the left. The spring 24 is also stressed in that movement. FIG. 13 also shows a pre-locking effect in a disadvantageous tolerance situation.

Figure 14:
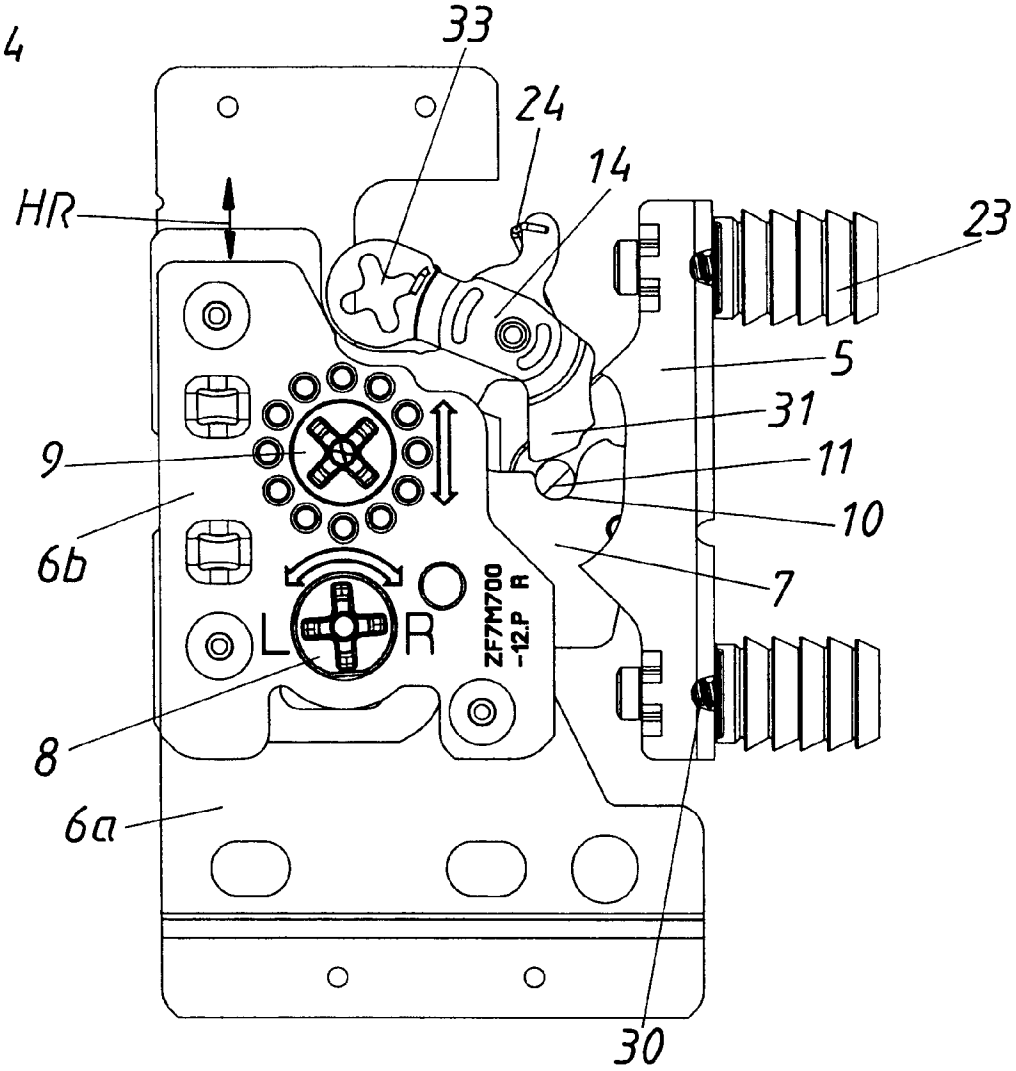
FIG. 14 shows a side view with the connecting element locked to the fastening device.

FIG. 14 shows the connecting element 5 and its latching element 11 in a position of being locked by the locking device 14, and the locking nose 31 is arranged above the latching element so that removal of the front panel 2 is thus prevented. It is only by actuation of the cross slot 33 and pivotal movement of the locking element 14 in the clockwise direction that the locking nose 31 is moved towards the left and thus releases the latching element 11. When the upper adjusting element 9 is actuated, the adjusting plate 7 is moved upwardly or downwardly respectively in the height direction HR relative to the plate portions 6*a* and 6*b*.

Figure 15:
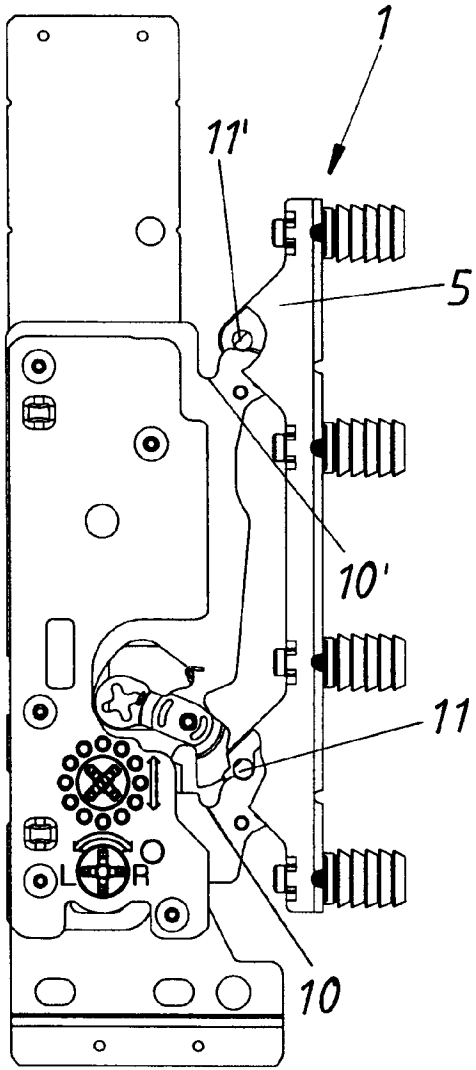
FIG. 15 shows a side view prior to connection of a connecting element for a high front panel.
Figure 16:
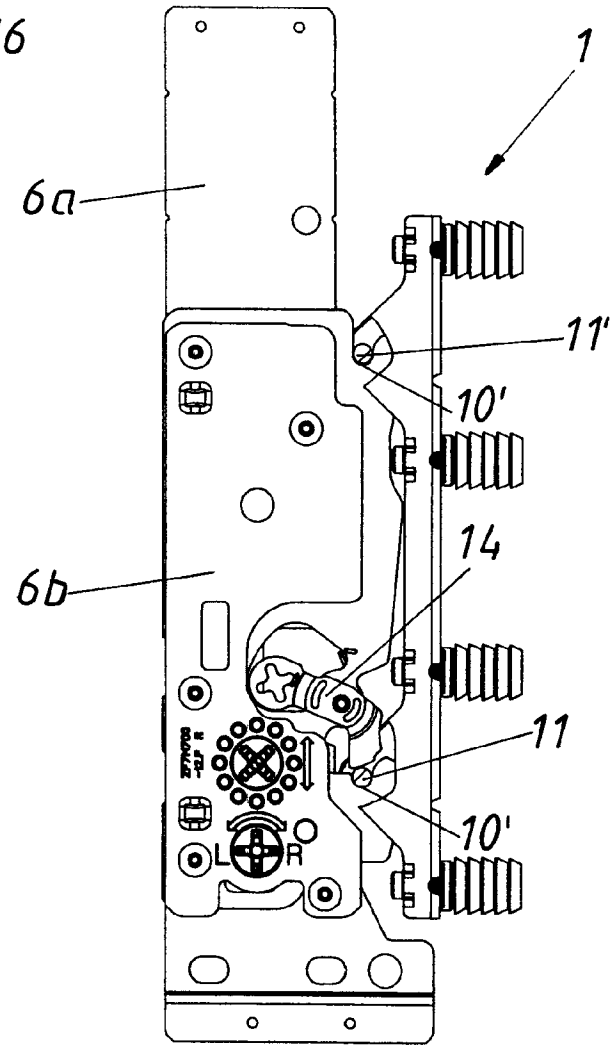
FIG. 16 shows a side view with locked connecting element for a high front panel.

FIGS. 15 and 16 show a one-piece connecting element 5 with two latching elements 11 and 11' which are hung at the two hang-in grooves 10 and 10' of the fastening device 4. In that respect, only one locking device 14 is required as locking is effected in the region of the upper hang-in groove 10' by way of the contour involved.

Figure 17:
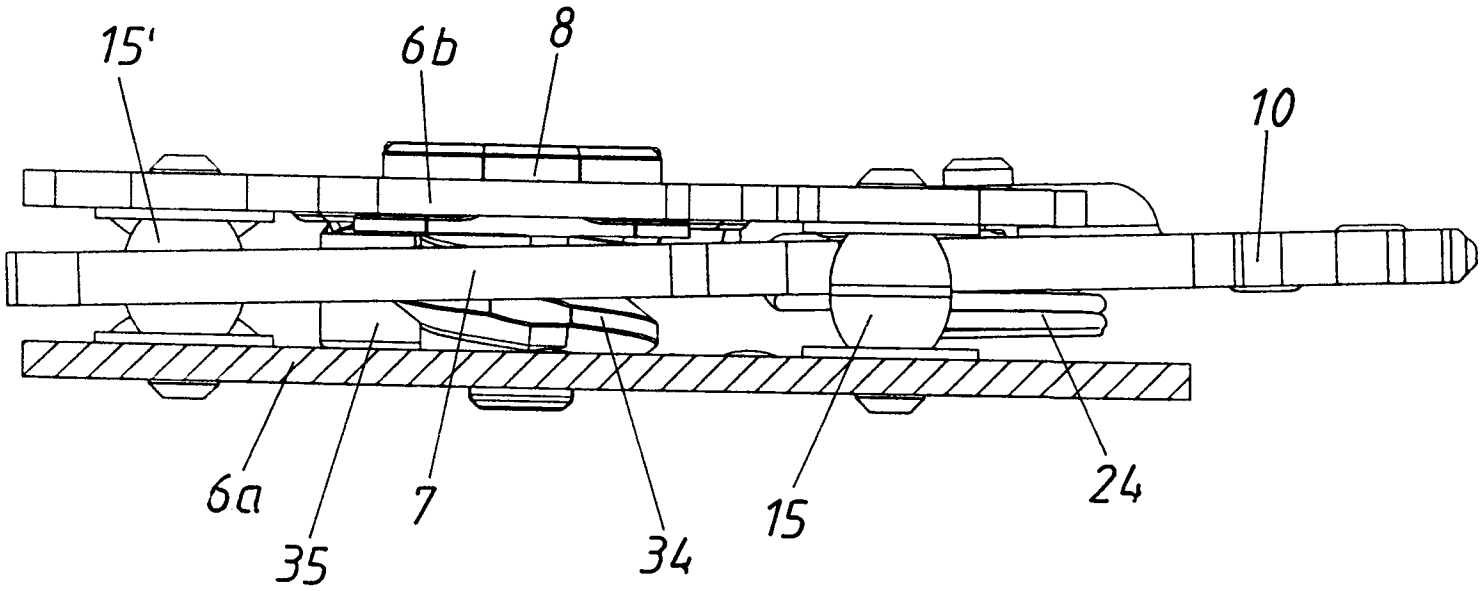
FIG. 17 shows a section through the fastening device with the laterally adjusted adjusting plate.
Figure 18:
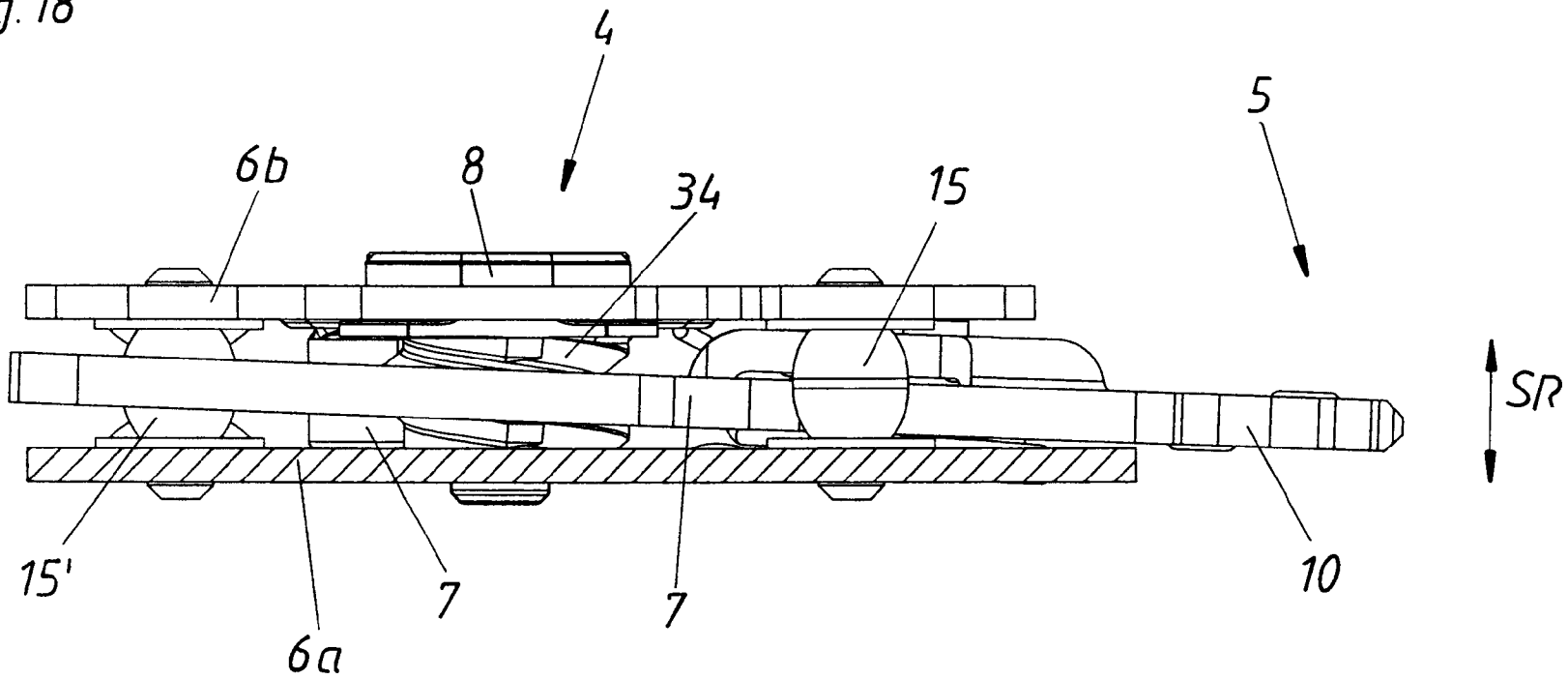
FIG. 18 shows a further section with laterally adjusted adjusting plate.

FIGS. 17 and 18 clearly show the lateral displacement or lateral pivotal movement of the adjusting plate 7 with respect to the plate portions 5*a* and 5*b* of the frame plate 6. By actuation or rotation of the adjusting element 8, the position of the thread 34 is changed and the adjusting plate 7 which is in contact in the flight of the screwthread is correspondingly pivoted as in the region remote from the front panel. The adjusting plate 7 is held on the mounting element 15' centrally between the plate portions 6*a* and 6*b*, so that the part of the adjusting plate 7 that is towards the front panel is displaced in the lateral direction SR.

Figure 20:
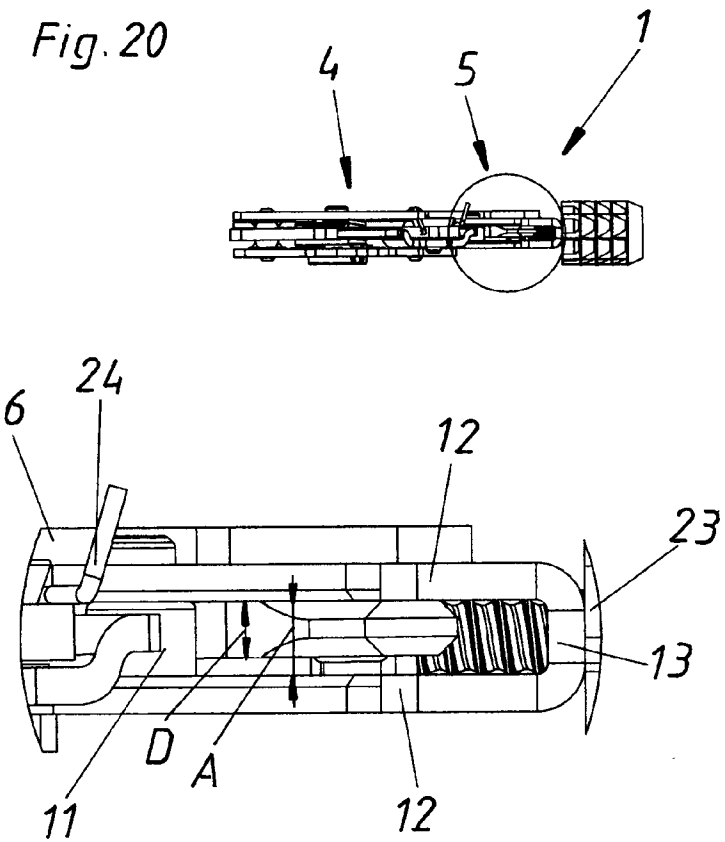
FIG. 20 shows a plan view of the adjusting plate in the central position.
Figure 19:
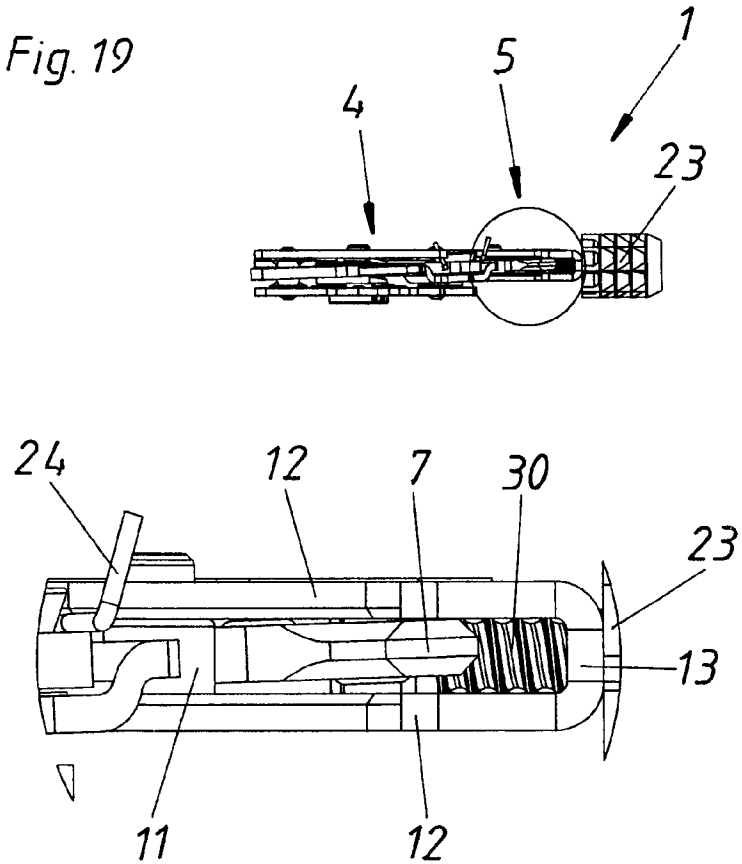
FIG. 19 shows a plan view of a laterally adjusted adjusting plate with connecting element.

FIGS. 19 and 20 show that the latching element 11 connects the two side plates 12 of the connecting element 5 of U-shaped cross-section, the side plates 12 being integrally connected together by the transverse limb 13. Upon only slight pivotal movement of the adjusting plate 7, because of the play (about 2/10 mm) between the adjusting plate 7 and the side plates 12 of the connecting element 5, there is scarcely any concomitant movement of the connecting element with the adjusting plate 7. Thus, scarcely any lateral displacement occurs. However, the more inclinedly that the adjusting plate 7 is adjusted, the correspondingly more does the connecting element 5 go along with the inclined positioning. This lateral adjustment mechanism affords overall a lateral adjustment through about 1.5 mm. It will be seen from FIG. 20 that the spacing A between the side plates 12 of the connecting element 5 is about 30% greater than the thickness D of the adjusting plate 7, thereby facilitating hanging engagement of the connecting element 5 on the fastening device 4.

The invention claimed is:

1. A furniture fitting for fastening a front panel to a drawer frame member, comprising:

a connecting element to be pre-mounted to the front panel, and a fastening device to be connected to the frame member, said fastening device including a frame plate, an adjusting plate, and adjusting elements rotatably arranged on said frame plate, said adjusting elements being configured to act on said adjusting plate so that said adjusting plate is displaceable relative to said frame plate in a height direction (HR) and in a lateral direction (SR), wherein said connecting element is configured to be hung on said adjusting plate and, in the hung condition, is configured and arranged to perform displacement movements of said adjusting plate relative to said frame plate.

2. The furniture fitting as set forth in claim 1, wherein said adjusting plate has at least one hang-in groove into which said connecting element is configured to be hung by a pin-shaped latching element.

3. The furniture fitting as set forth in claim 2, wherein said adjusting plate has two hang-in grooves into which said connecting element is configured to be hung by a respective pin-shaped latching element.

4. The furniture fitting as set forth in claim 1, wherein said connecting element has two substantially mutually parallel side plates, wherein arranged between said side plates is a pin connecting said side plates and forming said latching element to allow said connecting element to be hung on said adjusting plate of said fastening device.

5. The furniture fitting as set forth in claim 4, wherein said connecting element has a U-shaped cross-section, wherein said two substantially mutually parallel side plates are connected together by a transverse limb remote from said pin.

6. The furniture fitting as set forth in claim 1, wherein said fastening device has a locking device for releasably arresting said connecting element hung on said adjusting plate to said fixing device.

7. The furniture fitting as set forth in claim 1, wherein said adjusting plate is adjustable in the lateral direction (SR) with respect to said frame plate by a first adjusting element formed as a lateral adjusting device, and said adjusting plate is displaceable in the height direction (R) with respect to said frame plate by a second adjusting element formed as a height adjusting device.

8. The furniture fitting as set forth in claim 1, wherein said adjusting plate has a one piece construction, and both adjusting elements act on said one-piece adjusting plate.

9. The furniture fitting as set forth in claim 1, wherein said adjusting plate is connected non-releasably and movably to said frame plate by mounting elements.

10. The furniture fitting as set forth in claim 9, wherein said frame plate has two substantially mutually parallel and mutually fixed plate portions, and said adjusting plate is arranged between said two plate portions, said two plate portions and said adjusting plate being connected together by said mounting elements.

11. A drawer comprising:

a drawer bottom, a drawer rear wall, two drawer frame members forming the drawer side walls, and a front panel connected to said drawer frame members with two furniture fittings, each of said two furniture fittings being configured as set forth in claim 1.

12. An article of furniture comprising:

a furniture carcass, and a furniture part formed as a drawer having a configuration as set forth in claim 11, said drawer being movable relative to said furniture carcass.

* * * * *